US006298799B1

(12) United States Patent
Hirose

(10) Patent No.: US 6,298,799 B1
(45) Date of Patent: Oct. 9, 2001

(54) SEWING MACHINE CAPABLE OF TRACING EMBROIDERY AREA

(75) Inventor: Hirokazu Hirose, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/790,548

(22) Filed: Feb. 23, 2001

(30) Foreign Application Priority Data

Mar. 30, 2000 (JP) ..... 12-095016

(51) Int. Cl.[7] ..... D05C 5/02

(52) U.S. Cl. ..... 112/102.5; 112/239; 112/275; 112/475.19; 700/138

(58) Field of Search ..... 112/102.5, 239, 112/275, 470.06, 475.19; 700/138, 136, 137

(56) References Cited

U.S. PATENT DOCUMENTS 5,648,908 * 7/1997 Chirn et al. ..... 112/470.06 X
5,899,157 5/1999 Kurono et al. .
6,032,594 * 3/2000 Komuro ..... 112/102.5

FOREIGN PATENT DOCUMENTS 9-137365 5/1997 (JP) .
10-263236 10/1998 (JP) .

* cited by examiner

*Primary Examiner*—Peter Nerbun
(74) *Attorney, Agent, or Firm*—Oliff & Berridge, PLC

(57) ABSTRACT

When a trace mode is started, a needle and a presser foot are moved relative to an embroidery frame. When a STOP key is pressed, moving is temporarily stopped, and the operator can visually check a positional relationship between the needle and the embroidery frame. When it is necessary to check the positional relationship in detail, a DOWN key is pressed and the presser foot is lowered independently of the needle, so that the operator can visually check the positional relationship between the presser foot and the embroidery frame.

20 Claims, 10 Drawing Sheets

Fig.10 [ROUTINE FOR SELECTING PAUSE OR LOWERING OPERATION OF PRESSER FOOT]
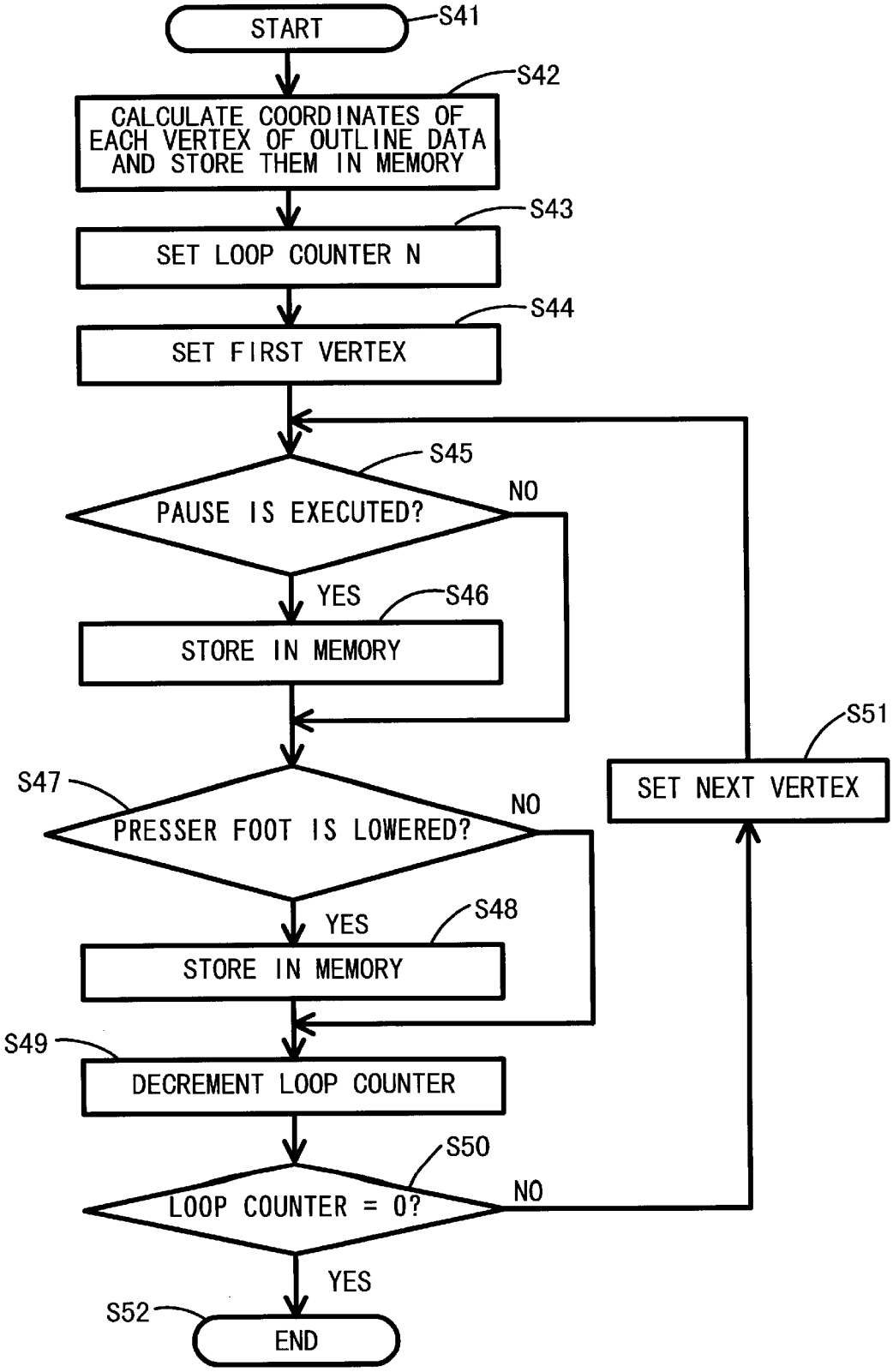

Fig.11 [ROUTINE WHILE EMBROIDERY FRAME IS STOPPED]
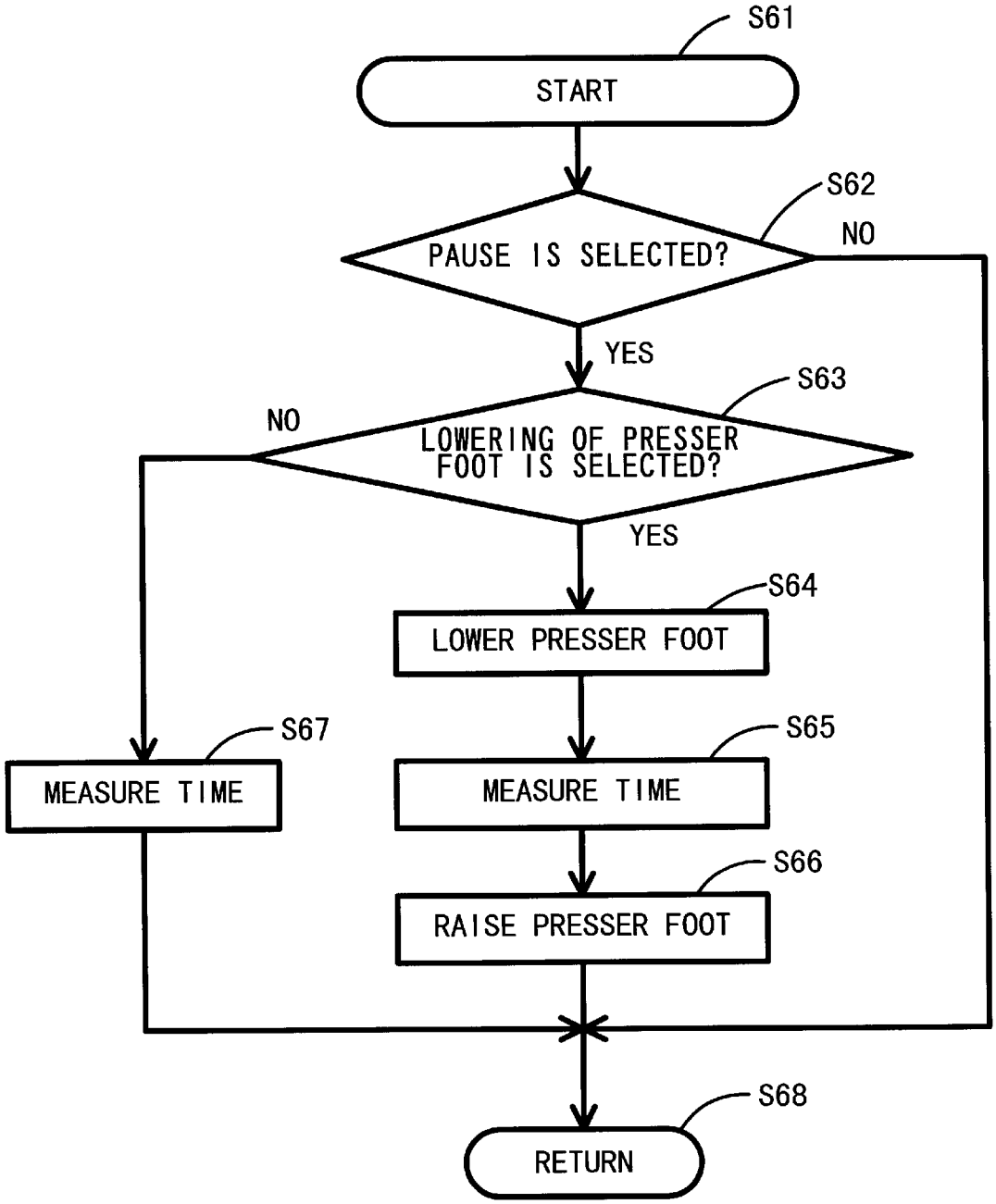

SEWING MACHINE CAPABLE OF TRACING EMBROIDERY AREA

BACKGROUND OF THE INVENTION

1. Field of Invention

The invention relates to a sewing machine capable of tracing an embroidery area on a cloth held by an embroidery frame.

2. Description of Related Art

Conventionally, there is an embroidery machine having an embroidery frame which holds a workcloth to embroider a pattern thereon within the embroidery frame. The size of a sewing area varies depending on the embroidery frame to be used or the embroidery pattern to be sewn. Before actual embroidering using a needle, the operator checks whether embroidering is possible by observing whether an embroidery area the operator wants is within the embroidery frame. To check the embroidery area, a trace mode is widely used in which a relative distance between the embroidery frame and the needle is checked by moving the embroidery frame holding the work cloth along the embroidery area, because the machine head does not move. In the trace mode, to prevent the presser foot and the needle from hitting the embroidery frame during actual embroidering, the trace operation is usually performed with the presser foot and the needle at their highest positions.

In a conventional trace mode, an embroidery area checking method is proposed in Japanese Laid-Open Patent Application Publication No. 9-137365. In the embroidery area checking method, a trace speed is controlled by a program that enables the trace speed to change based on the positional relationship between outline data for an embroidery area including an embroidery pattern and an embroidery frame.

However, in the above-mentioned embroidery machine, the embroidery frame can be moved with a variable speed or stopped during a trace operation, but the trace operation is made with the needle and the presser foot raised. When the embroidery frame is positioned too close to the outline of the embroidery area, to check whether the needle or the presser foot will hit the embroidery frame during actual embroidering, the operator has to lower a presser foot lever mounted on the side of the machine head manually so as to lower the presser foot. Moving the presser foot lever prevents needle marks on a work cloth that might occur if the needle were lowered. In this case, for an embroidery machine with multiple heads, each head having multiple needles, it is difficult for the operator to stretch out his/her arm to the presser foot lever mounted on the side of the head so as to lower the presser foot according to the position of the selected needle. As a result, the checking operation is not performed easily in the trace mode to check whether the embroidery pattern can be sewn in the right place.

SUMMARY OF THE INVENTION

The invention provides a sewing machine that enables easy checking of an embroidery pattern with tracing of an embroidery area.

In a preferred aspect of the invention, a sewing machine capable of tracing an embroidery area that includes an embroidery pattern before embroidering onto a cloth held by an embroidery frame, by moving a needle and a presser foot, which are away from the cloth, relative to the embroidery frame along an outline of the embroidery area, while stopping at one or more stop points may include an actuator that lowers the presser foot and a lowering device that controls the actuator to lower the presser foot at the one or more stop points during a trace operation.

Usually the trace operation is performed by relatively moving the needle and the presser foot, the needle and presser foot withdrawn from the cloth, along the outline of the embroidery area, to make sure that the needle and the presser foot do not hit the embroidery frame before actual embroidering. If it is difficult to check whether embroidering is possible before actual embroidering, because the outline of the embroidery area is too close to the embroidery frame, the lowering device lowers the presser foot independently of the needle during a pause of the trace operation, so the operator can check the positional relationship between the presser foot and the embroidery frame. This eliminates needle marks on the cloth and the operator having to lower the presser foot manually. This also allows the easy checking of an embroidering area for an embroidery machine with multiple heads.

In another preferred aspect of the invention, the sewing machine may further include a measuring device that measures time elapsing while the presser foot is lowered at the one or more stop points, wherein the needle and the presser foot are relatively moved to a next stop point when the time measured by the measuring device has reached a predetermined time.

Therefore, when the needle and the presser foot relatively move to the stop point, the lowering device lowers the presser foot and the measuring device starts to measure the time elapsing while the presser foot is lowered at the stop point. After the time measured by the measuring device has reached the predetermined time, the needle and the presser foot relatively move to a next stop point.

When the outline of the embroidery area is too close to the embroidery frame, it is necessary to check whether embroidering is possible by checking the in-depth positional relationship among the needle, the presser foot and the embroidery frame. In this case, if a point to check the positional relationship is selected as required, relative movement is suspended at the point during the trace operation, so that only the presser foot can be lowered, independently of the needle, for a predetermined time. The point selection can be made in advance or during the trace operation. This allows easy checking of the embroidering area.

In a preferred aspect of the invention, the sewing machine may further include a point selecting device that selects at least one of the one or more stop points as a lowering point where the presser foot is lowered.

Accordingly, a stop point can be selected as a point where the presser foot is lowered. The presser foot can be lowered only at a point requiring detailed checking. This improves the efficiency of the embroidery area checking.

In a preferred aspect of the invention, the point selecting device selects the at least one of the one or more stop points as the lowering point during the trace operation.

Thus, it is possible to select whether the presser foot is lowered at the next stop point while the needle and the presser foot relatively move from the start of the embroidery area checking. This improves the efficiency of the trace operation.

In a preferred aspect of the invention, the sewing machine may include a memory; a setting device, that stores, in the memory, the one or more stop points and one or more lowering points where the presser foot is lowered; and a measuring device that measures time elapsing while the presser foot is lowered at the one or more lowering points, wherein the needle and the presser foot relatively move with stops at the one or more stop points based on settings in the memory, where the presser foot is lowered by the lowering device at the one or more lowering points based on the settings in the memory, and the needle and the presser foot relatively move to a next stop point when the time measured by the measuring device has reached a predetermined time.

Therefore, the stop points and the points where the presser foot is lowered can be set in the memory in advance. The trace operation can be automatically executed based on the setting in the memory. Accordingly, the embroidery area can be checked without the need to set the stop points and the point where the presser foot is lowered during the trace operation.

BRIEF DESCRIPTION OF THE DRAWINGS

The invention will be described in greater detail with reference to preferred embodiments thereof and the accompanying drawings wherein;

FIG. 10 is a flowchart of a routine for selecting a pause or lowering operation of the presser foot in advance and storing the selection in the memory; and FIG. 11 is a flowchart of a routine while the embroidery frame is stopped in a case where a pause or lowering operation of the presser foot is selected in advance and pre-stored in the memory.

DETAILED DESCRIPTION OF PREFERRED EMBODIMENTS

Figure 1:
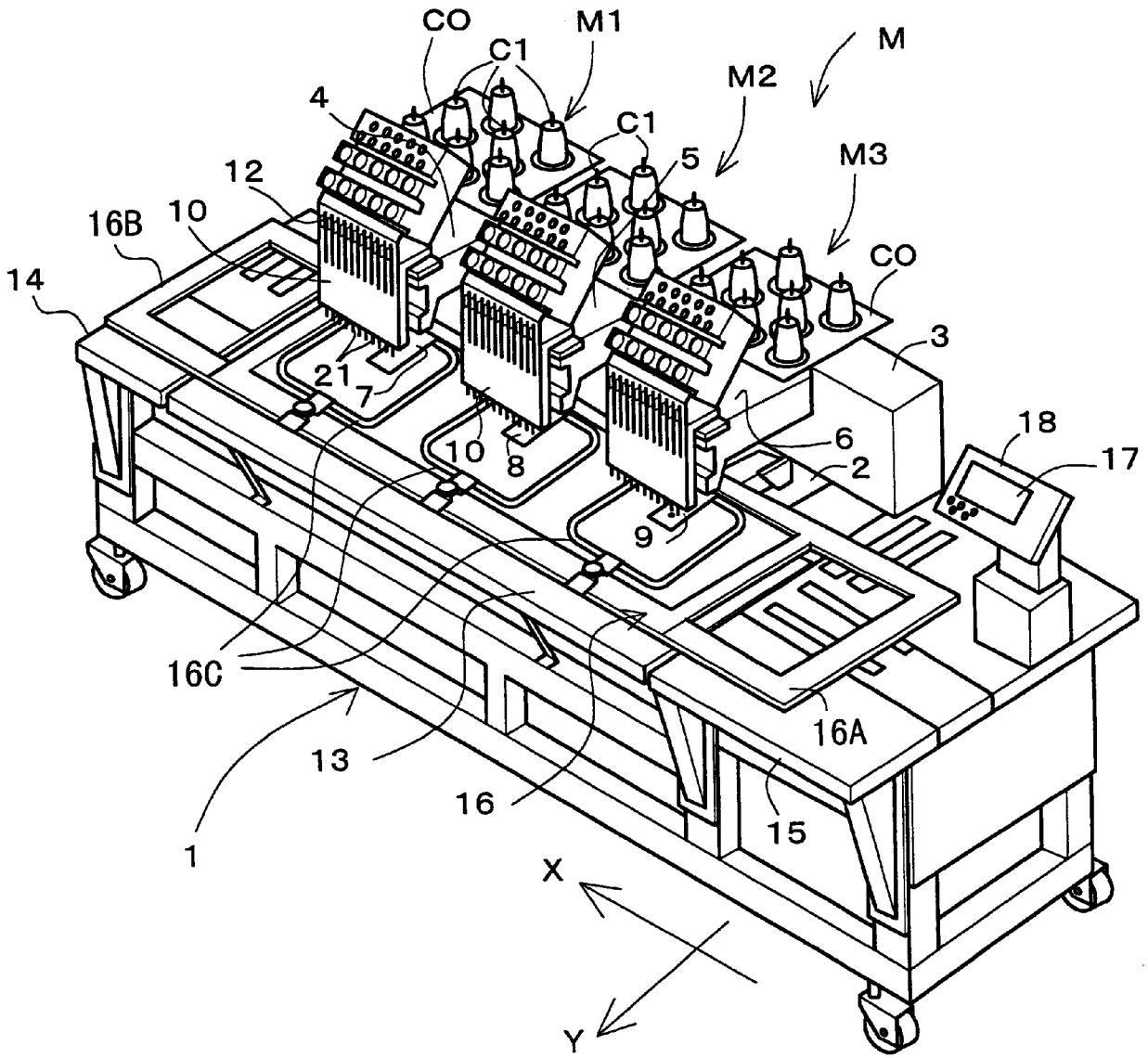
FIG. 1 is a perspective view of an embroidery machine with multiple heads.

An embodiment of the invention will be described in detail with reference to the accompanying drawings. FIG. 1 shows an embroidery machine with multiple heads M, in a perspective view, in which three embroidery machines M1, M2, M3 are arrayed.

The embroidery machine M includes a laterally extending base frame 1, a machine supporting stand 2 which is secured on the rear of the base frame 1, and a laterally extending supporting frame 3 which is disposed at a rear portion of the machine supporting stand 2 and arranged lengthwise in a standing position.

The base frame 1 provides three machine head portions 4, 5, and 6 thereon. The head portions 4 to 6 have respective cylindrical bed portions 7, 8, 9 thereunder. Thus, three embroidery machines M1, M2, M3 comprise the head portions 4, 5, 6 and the bed portions 7, 8, 9, respectively.

A needle bar case 10 that is laterally movable is attached to the front of each of the head portions 4 to 6. In each needle bar case 10, twelve needle bars 21, which are arranged in a row right to left, are supported so that they can be moved up and down, and corresponding twelve thread take-ups 12 are also pivotally supported.

The needle bar cases 10 are concurrently moved laterally by their respective needle bar changing mechanisms (not shown) each changing a needle bar 21 to be used, so that a different color of needle thread can be used.

At the front of the machine-supporting stand 2, a worktable 13 is horizontally disposed on a level with bed portions 7 to 9. A pair of auxiliary tables 14, 15 is disposed on each side of the worktable 13. A movable frame 16, having a rectangular shape and extending laterally, is placed on the worktable 13, and the auxiliary tables 14, 15.

The movable frame 16 is moved via a right frame 16A and a left frame 16B both which are moved in an X direction (right and left in FIG. 1) by an X-axis driving mechanism (not shown), and in a Y direction (back and forward in FIG. 1) by a Y-axis driving mechanism (not shown).

A plurality of embroidery frames 16C corresponding to embroidery machines M1 to M3 are attached to the movable frame 16. As the movable frame 16 is moved on an X-Y coordinate system plane by the X- and Y-axis driving mechanisms, the embroidery frames 16C are also movable in the X and Y directions.

A plurality of spools C1 are rotatably placed on a spool stand C0 attached to the upper part of the machine-supporting stand 2. A needle thread C2 supplied from a spool C1 is threaded to a needle bar 21, described later, via associated parts including the corresponding thread take-up 12. At the rear of the auxiliary table 15, there is provided an operation panel 18 having a plurality of switches (not shown) and a liquid crystal display 17 for displaying various messages addressed to embroidering.

Figure 2:
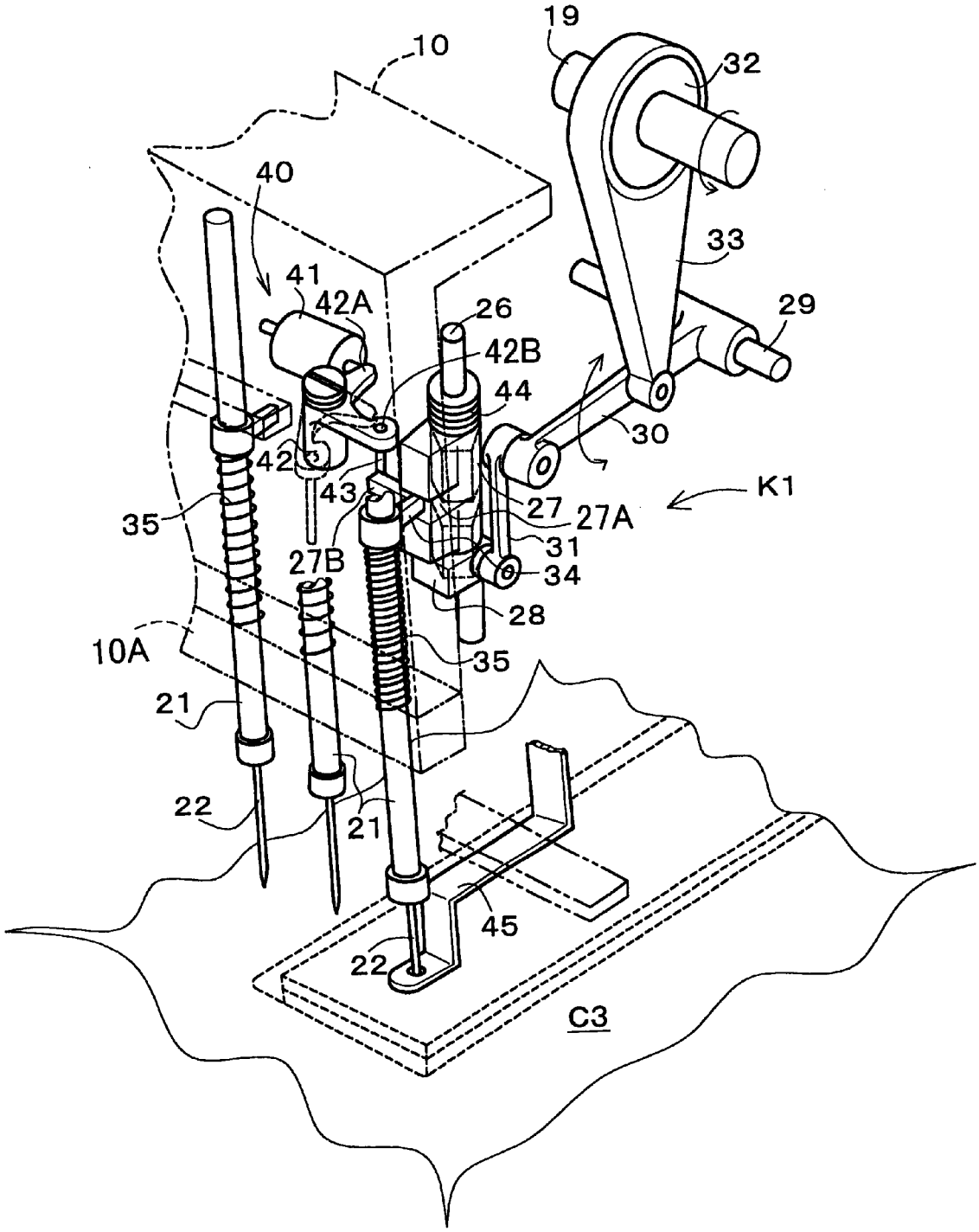
FIG. 2 shows a plurality of needle bars and a needle bar driving mechanism in the machine in an enlarged perspective view.

Next, a needle bar up and down moving mechanism K1 that is provided for each of the embroidery machines M1 to M3 will now be described briefly with reference to FIG. 2. A more detailed description can be found in U.S. Pat. No. 6,123,037, issued Sep. 26, 2000, the disclosure of which is incorporated herein by reference. FIG. 2 shows the needle bars 21 and the needle bar up and down moving mechanism K1 in an enlarged view. The mechanism K1 moves a needle bar 21 vertically in time with operation of a machine main shaft 19. Accordingly, the needle 22 attached to the bottom of the needle bar 21 is moved vertically.

At the rear of the needle bar case 10, the machine main shaft 19 is disposed laterally through the head portions 4 to 6. The machine main shaft 19 passes through an eccentric cam 32. The eccentric cam 32 is fitted in an eccentric lever 33, which is linked to a rocking lever 30.

A master needle bar 26 extending vertically is disposed at the front edge of each of the head portions 4 to 6. The master needle bar 26 is supported to a frame inside the needle bar case 10 at its upper and lower ends. A vertically movable segment 27 is movably fitted around the master needle bar 26. The movable segment 27 has a groove 27A engageable with a linking pin 34 described later. A needle bar connecting stud 28, which is disposed under the movable segment 27, is attached to a link 31 which is attached to the rocking lever 30, which is movably pivoted by a pivot shaft 29.

A compression spring 35 is fitted around the needle bar 21 and interposed between the pin 34 and the supporting frame 10A of the needle bar case 10. The needle bar 21 is always urged by the spring 35 to its upper needle stop position.

When the needle bar case 10 is moved in the lateral direction, the pin 34 attached to the needle bar 21 corresponding to the movable segment 27 is selectively fitted into the groove 27A.

Figure 3:
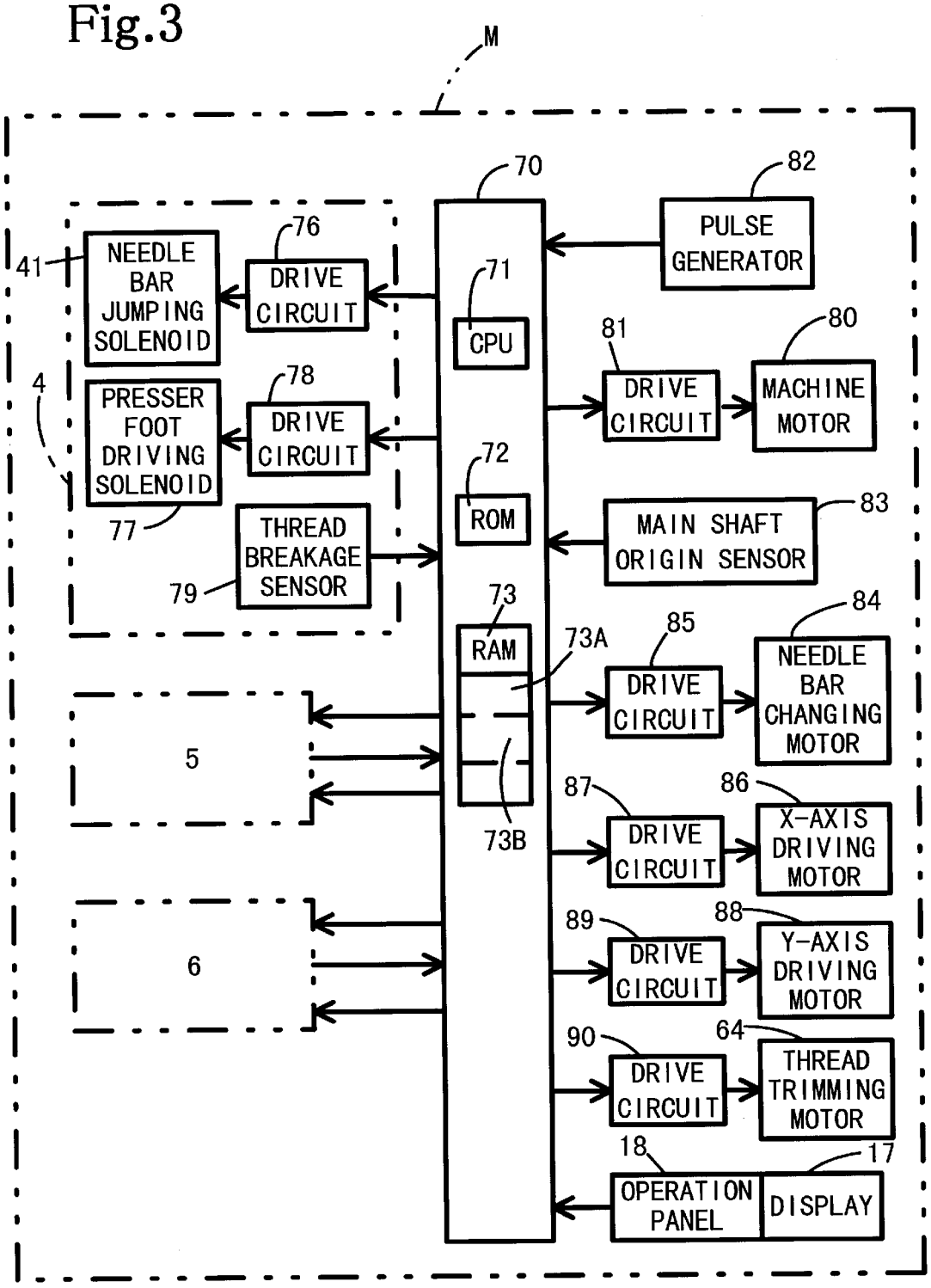
FIG. 3 is a block diagram showing a control system of the machine.

With this arrangement, upon rotation of a machine motor 80, FIG. 3, in a predetermined rotational direction, the machine main shaft 19 is rotated about its axis, so that the movable segment 27 and the needle bar connecting stud 28 are integrally reciprocally moved in the vertical direction by way of the eccentric lever 33, the rocking lever 30, and the link 31. As a result, only the needle bar 21 engaged with the movable segment 27 through the pin 34 is vertically reciprocally moved in a timed relation with the rotation of the machine main shaft 19.

A needle bar jumping mechanism 40, provided for each of embroidery machines M1 to M3 will be described with reference to FIG. 2. The needle bar jumping mechanism 40 jumps the needle bar 21 to its highest position or top end point to change the needle bar 21 to be engaged with the movable segment 27.

Mounted inside the needle bar case 10 is a needle bar jumping solenoid 41, which is in a horizontal position, and a rotating lever 42, which is substantially L-shaped when viewed from the top, and pivotable about a vertical axis.

A driving part 42A of the rotating lever 42 makes contact with a plunger of the solenoid 41, and an operation shaft 43, which is vertically attached to a driven part 42B, is engageable with an engaging member 27B which projects from the vertically movable segment 27.

The vertically movable segment 27 is rotated between its linking position (regular position) indicated by a solid line and its jump position where the segment 27 is rotated for a fixed angle counterclockwise from the regular position. A coil spring 44, which is disposed at an upper position of the segment 27, normally urges the segment 27 so as to rotatably move from the jump position to the regular position.

When the needle bar 21 is linked to the vertically movable segment 27 via the pin 34, the needle bar jumping solenoid 41 is driven for a predetermined time, and its plunger is moved into the right. The rotating lever 42 is rotated clockwise when viewed from the top, and the vertically movable segment 27 is concurrently rotated to the jump position via the shaft 43 and the engaging member 27B. Consequently, the pin 34 is disengaged from the groove 27A. At this time, the needle bar 21 is urged by the compression spring 35 to promptly move to the highest position (perform the jumping operation).

On the other hand, when the needle bar 21 is in the jump condition at its highest position and the vertically movable segment 27 has returned to the regular position and rises from the down position to its highest position, the segment 27 makes contact with the pin 34 from the bottom. At this time, the segment 27 is rotated temporarily to the jump position, and is urged by the coil spring 44 immediately to return to the regular position. Therefore, the pin 34 is automatically fitted into the groove 27A.

Each of the bed portions 7 to 9 is provided with a presser foot 45 that is driven by a presser foot driving mechanism, not shown. The position of the presser foot 45 can be changed between a pressing position where the presser foot 45 presses a work cloth C3 on the associated bed portion and a retracting position positioned above the pressing position by a predetermined distance. The presser foot driving mechanism of the presser foot 45 is a publicly known mechanism, for example, as disclosed in Japanese Laid-Open Patent Publication No. 10-263236.

A control system for the machine M will be described with reference to FIG. 3. FIG. 3 is a block diagram of the control system described in the embodiment.

The machine M comprises the operation panel 18 with the LCD display 17, a drive circuit 81 for driving a machine motor 80, a drive circuit 87 for driving an X-axis driving motor 86, a drive circuit 89 for driving a Y-axis driving motor 88, a drive circuit 85 for driving a needle bar changing motor 84 that moves the needle bar case 10 to change a needle bar 21, and a drive circuit 90 for driving a thread trimming motor 64. The drive circuits 81, 85, 87, 89, 90 are connected to the controller 70. The controller 70 comprises a CPU 71, a ROM 72, and a RAM 73, which are connected to an input/output interface, not shown, via a data bus.

The ROM 72 stores a plurality of embroidery data for each embroidery pattern, a control program for embroidering formed by driving the Y-axis driving motor 88 and the X-axis driving motor 86 based on the embroidery data, and data required for trace mode control, which will be described later.

The RAM 73 provides a memory 73A which is work memory storing embroidery data required to embroider patterns, and a memory 73B that temporarily stores a result of movement amount of the movable frame 16 calculated by the CPU 71. Data stored in the memories 73A and 73B are taken out by the CPU 71 at any time to use for embroidery operations and trace operations.

As to the head 4, there are provided a drive circuit 76 for driving the solenoid 41 for the needle bar jump mechanism 40 disposed in the needle bar case 10, a drive circuit 78 for a presser foot driving solenoid 77 as an actuator that moves the presser foot 45 vertically, and a thread breakage sensor 79. The drive circuits 76, 78 and the thread breakage sensor 79 are connected to the controller 70. As with the head 4, the same is true of the head portions 5 and 6.

The thread breakage sensor 79 detects the needle thread has been broken. The CPU 71 generates data to execute a thread trimming operation based on the output of the sensor 79.

The controller 70 is connected to a pulse generator 82, a main shaft origin sensor 83, and the operation panel 18 having the LCD display 17. The pulse generator 82 outputs an encoder signal comprised of 1000 pulse signals made in one turn of an encoder disk disposed at the machine main shaft 19. The origin sensor 83 outputs a synchronization signal at one turn of the encoder disk.

The ROM 72 stores therein control programs for controlling the motors 64, 80, 84, 86, 88 based on the encoder signal issued from the pulse generator 82 and the synchronization signal from the origin sensor 83, and the execution programs used in a trace mode described later, including programs enabling a pause in the trace mode, and lowering operation of the presser foot 45 during the pause.

Figure 4:
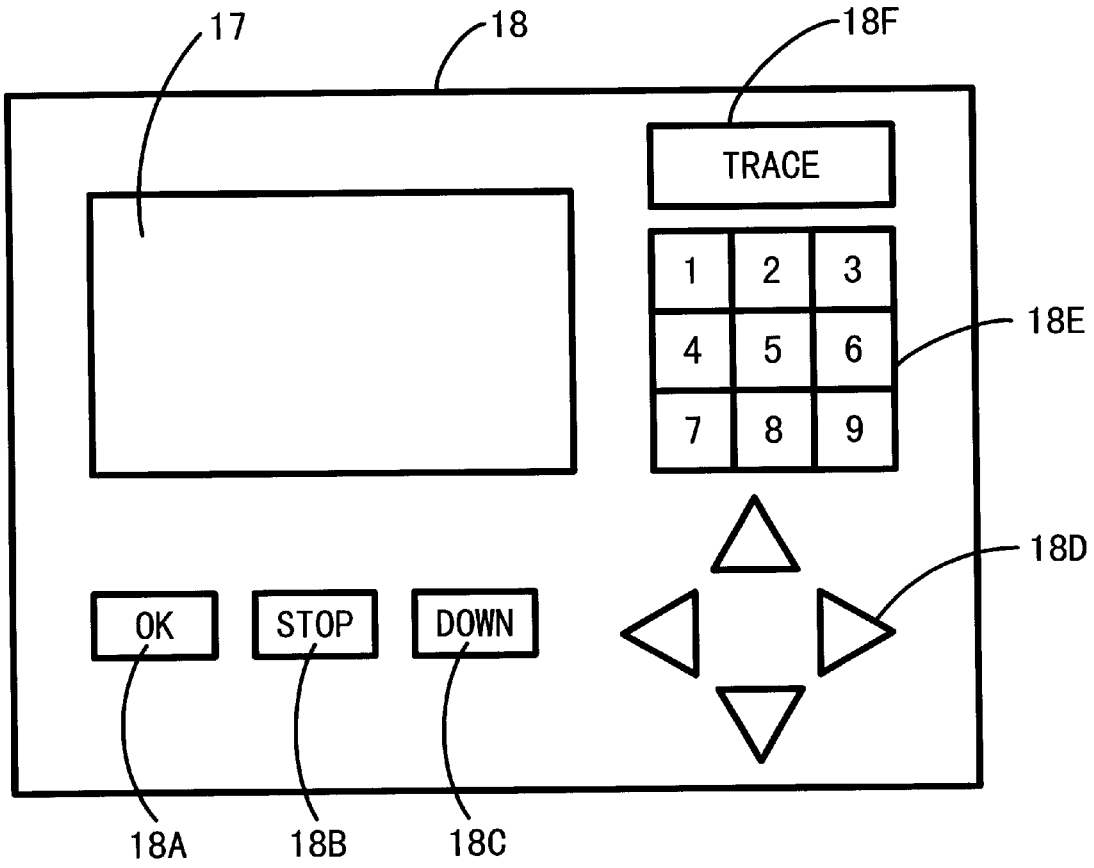
FIG. 4 is an enlarged plan view of an operation panel.

Next, the operation panel 18 will be now described. FIG. 4 shows the operation panel 18 in an enlarged plan view. The operation panel 18 has an OK key 18A for decision making in various cases, a STOP key 18B for suspending the trace operation, a DOWN key 18C for lowering the presser foot 45 temporarily, four direction arrow keys 18D for selecting the trace speed and direction, a number key pad 18E for selecting a stop position in the trace operation, and a TRACE key 18F for performing the trace operation. These keys are just exemplary. Operations can be selected using other media, such as a mouse.

The needle bar changing motor 84 moves the needle bar case 10 of each of the embroidery machines M1 to M3 to the right and left, to select a needle bar 21 to be used for embroidering. Therefore, the selected needle bar 21 on each machine is always at the same position. In other words, the position of the movable frame 16 on the X-Y coordinate system determines the relative position between the embroidery frame 16C and the needle 22 for each of machines M1 to M3. The X-axis driving motor 86 and the Y-axis driving motor 88 are pulse motors, therefore the movable frame 16 is moved approx. 0.1 mm every pulse applied to the motors 86, 88. In other words, the embroidery frames 16C are moved approx. 0.1 mm in the X- or Y-axis direction every pulse, with respect to the corresponding needle 22.

Actually in the trace mode, the needle 22 moves in no direction, and the movable frame 16 moves in four directions with respect to the needle 22. For convenience, however, the description will be provided under the assumption that the embroidery frame 16C is stopped and the needle 22 moves in four directions with respect to the embroidery frame 16C in the embodiment.

Figure 5:
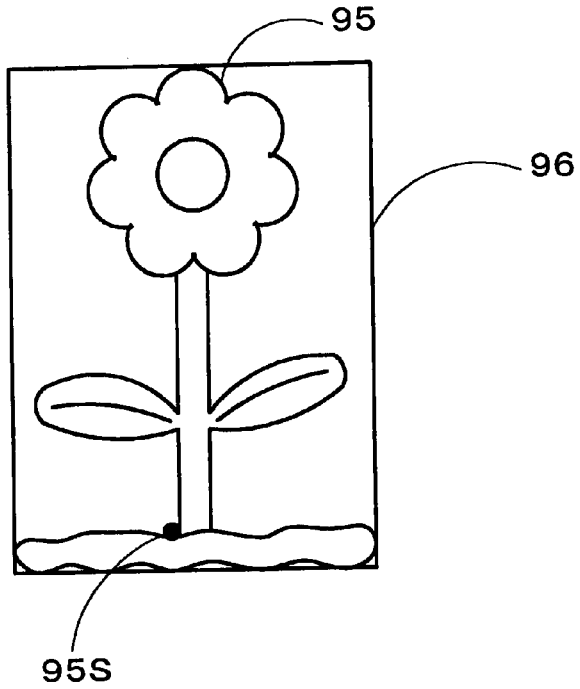
FIG. 5 shows an example of a pattern to be embroidered on the machine.
Figure 6:
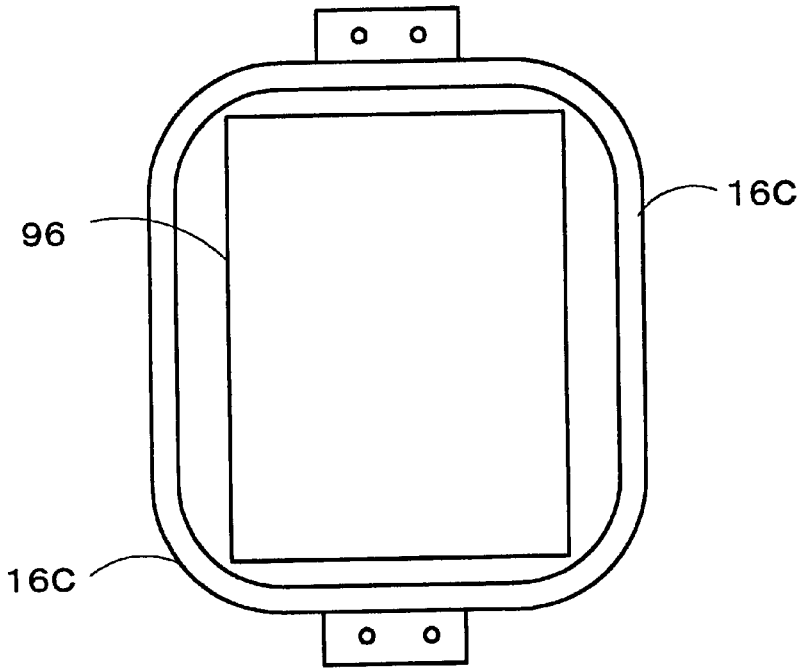
FIG. 6 shows a positional relationship between an embroidery frame and outline data for an embroidery area.
Figure 7:
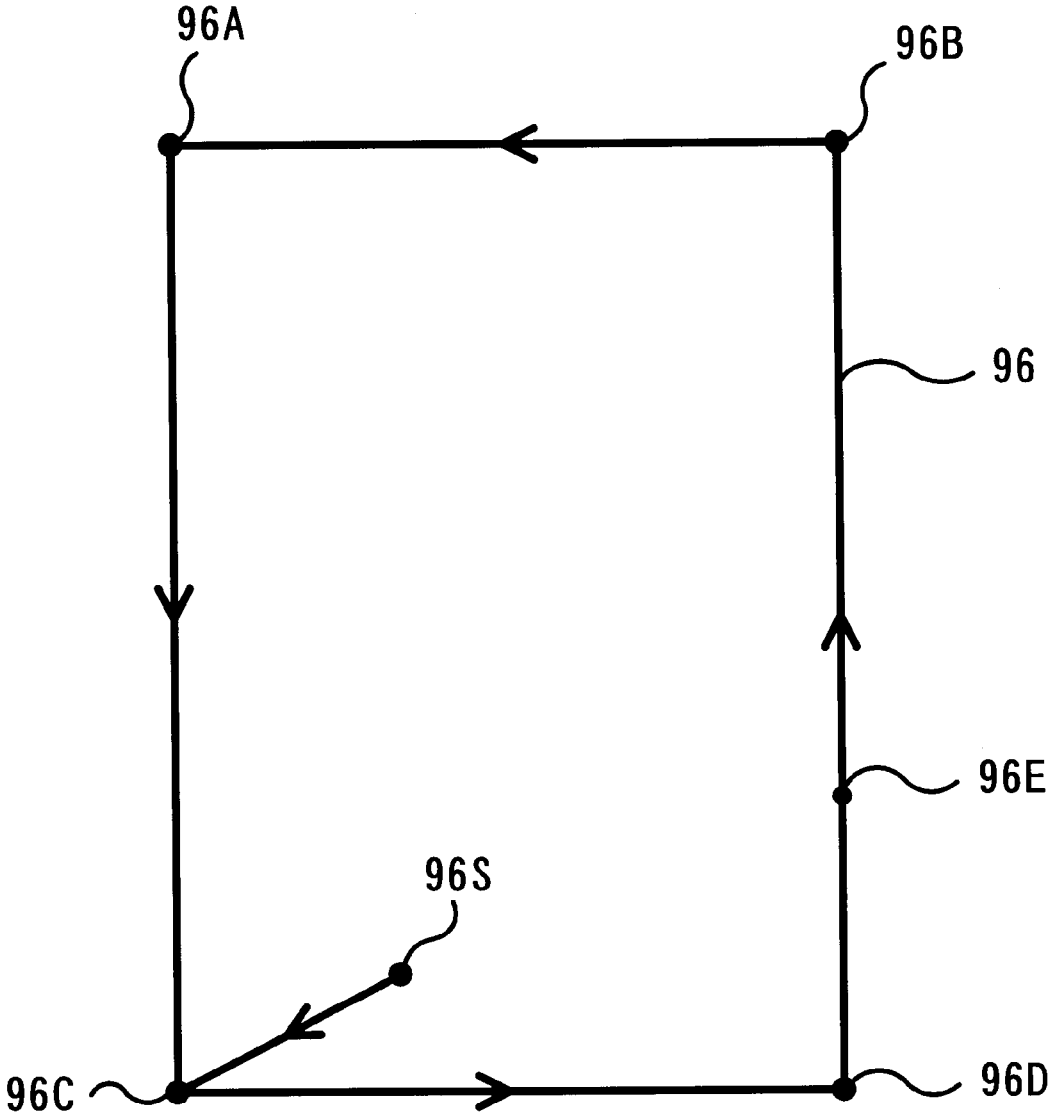
FIG. 7 shows a sequence of a trace operation.

Next, the relationship between the embroidery frame 16C and outline data 96 for an embroidery area will be described. FIG. 5 shows an example of a pattern 95 to be embroidered on the machine M. FIG. 6 shows a positional relationship between the embroidery frame 16C and the outline data 96 for the pattern 95 to be embroidered on the machine M. FIG. 7 shows a sequence of the trace operation.

When the pattern 95, shown in FIG. 5, is embroidered using the embroidery frame 16C, shown in FIG. 6, the machine M checks whether the pattern 95 is completely within the embroidery frame 16C before actual embroidering. This is because the needle 22 may come into contact with the frame 16C, the needle 12 may be broken in a worse case, if embroidering is started when the pattern 95 is not fully enclosed within the frame 16C.

As shown in FIG. 6, the embroidery frame 16C is rectangular, and the outline data 96 is also rectangular and large enough to enclose the pattern 95 shown in FIG. 5 completely. In the trace mode where the needle 22 and the presser foot 45 are relatively moved, while at their highest positions, along the outline data 96 for the embroidery area as shown in FIG. 7, the operator checks whether the trace of the needle 22 is done within the embroidery frame 16C, by checking the relative position between the needle 22 and the embroidery frame 16C.

When the pattern 95 is embroidered from a starting point 95S, shown in FIG. 5, a trace starting point 96S, shown in FIG. 7, corresponds to the point 95S. The trace is normally performed in the order starting from the point 96S through points 96C, 96D, 96B, 96A, and ending at the point 96C. The points 96A, 96B, 96C, 96D are at the corners of the outline data 96. It may be desirable to slow down the trace speed or make a stop at points placed on the corners because the direction of the trace changes at these points.

At the corners of the outline data 96, the positional relationship between the outline data 96 and the embroidery frame 16C becomes the closest, and it is very important to check whether the positional relationship is within the sewing area. Therefore, a trace operation is suspended at the corners, so that the presser foot driving solenoid 77 is actuated as necessary to lower the presser foot 45 independently of the needle 22. This enables the operator to visually check whether the needle 22 does not interfere with the embroidery frame 16C during embroidering.

Next, the trace operation in the above-mentioned embroidery machine with multiple heads M will be described with reference to the flowcharts of FIGS. 8 to 11. The trace operation includes checking by lowering the presser foot 45. The machines M1 to M3 are identical with one another, therefore a description will be provided with respect to one machine M1 and under the assumption that the preparations are all made, such as reading the outline data 96, setting the work cloth C3 in the embroidery frame 16C, and specifying the trace start point 96S.

When the trace key 18F is pressed on the operation panel 18, the trace mode is started. In step 1 (hereinafter step is abbreviated to S) of FIG. 8, the CPU 71 starts the trace mode where the relative position between the embroidery frame 16C and the outline data 96 of the embroidery area covering the pattern 95 is checked. In advance of relative movement, the CPU 71 checks the current position of the embroidery frame 16C and stores coordinates of the embroidery frame 16C into the memory 73B (S2). The CPU 71 calculates coordinates of each vertex of the outline data 96 based on embroidery data of the pattern 95 which is stored in the memory 73A, examples of such calculations are found in U.S. patent application Ser. No. 09/533,928, filed Mar. 23, 2000, the disclosure of which is incorporated by reference, and stores the coordinates into the memory 73B (S3). The CPU 71 adds a trace starting point 96S for the outline data 96 corresponding to the sewing start point 95S of the embroidery pattern 95, to the number of vertexes of the outline data 96, which is found at S3 (five points in this case). The CPU 71 sets the number (N=5 in this case) as a loop counter in the memory 73B (S4). Then, the CPU 71 sets the coordinates of the trace starting point 96S, which is the first vertex, to a point where the embroidery frame 16C is moved in the memory 73B (S5).

The CPU 71 moves the embroidery frame 16C to the set point (S6), suspends the relative movement of the embroidery frame 16C and executes a routine while the embroidery frame 16C is stopped (S7), which includes an operation to lower the presser foot 45. The details of the routine will be described later with reference to FIG. 9. When the routine is completed, the CPU 71 decrements the loop counter value (N) (S8), and checks N (S9). If N has a value (S9: No), the CPU 71 sets the coordinates of the next vertex to the point where the embroidery frame 16C is moved (S10), and returns to S6 to repeat the same processing. When N is equal to 0 (S9: Yes), the CPU 71 moves the embroidery frame 16C to the coordinates of the original frame position stored in S2 (S11), and finishes the trace mode (S12).

The routine while the embroidery frame 16C is stopped in S7 will be described in detail with respect to FIG. 9. When the routine is started (S21), the CPU 71 checks whether the STOP key 18B on the operation panel 18 is turned on (S22). When it is not turned on (S22: No), a pause is assumed not to be selected at the vertex. The CPU 71 immediately exits the routine, returns to the main routine (S28), and executes S8 and the following steps in FIG. 8. When the STOP key 18B is turned on (S22: Yes), the embroidery frame 16C is temporarily stopped, so that the operator can visually check the positional relationship between the needle 22 and the embroidery frame 16C. This state can be continued so long as the OK key 18A and the DOWN key 18C are not selected (S23, S24: No). When the operator checks the positional relationship without the need to lower the presser foot 45, the operator selects the OK key 18A (S23: Yes), and the CPU 71 immediately exits the routine, returns to the main routine (S28), and executes S8 and the following steps in FIG. 8. When it is necessary to check the positional relationship in detail, the operator does not select the OK key 18A (S23: No) but, rather, selects the DOWN key 18C (S24: Yes). The presser foot 45 is lowered (S25), so that the operator can check the positional relationship between the needle 22 and the embroidery frame 16C via the relationship between the presser foot 45 and the embroidery frame 16C. This state can be continued so long as the OK key 18A is not selected (S26: No). When the operator completes checking the positional relationship, the operator selects the OK key 18A (S26: Yes), and the CPU 71 immediately exits the routine, returns to the main routine (S28), and executes S8 and the following steps in FIG. 8. S25 functions as a lowering device of the invention, and the DOWN key 18C functions as a point selecting device.

Figure 9:
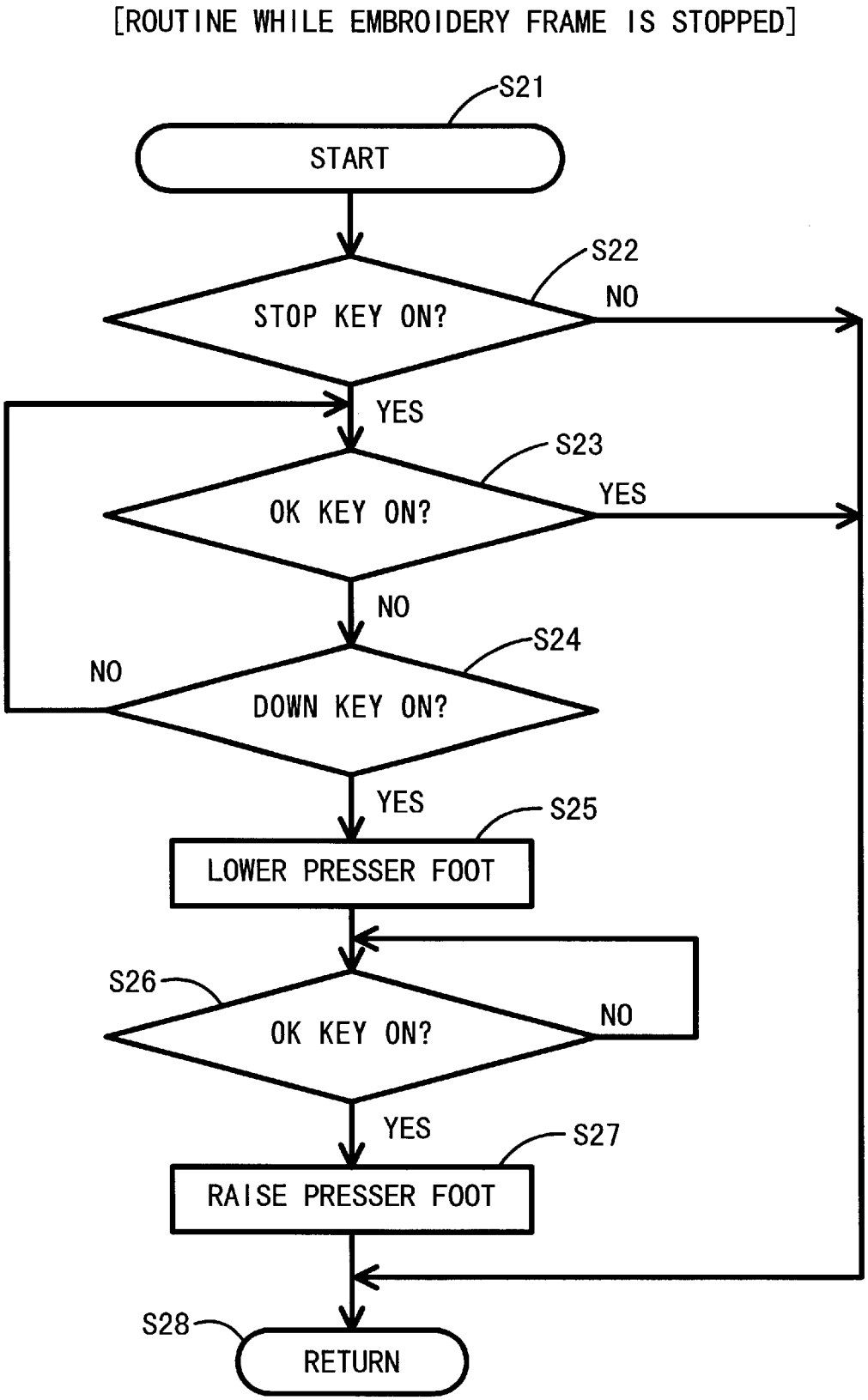
FIG. 9 is a flowchart of a routine while the embroidery frame is stopped.

In FIG. 9, the operator manually selects a pause and the execution of a lowering operation of the presser foot 45 at each vertex during the trace operation. The vertexes of the outline data 96 close to the embroidery frame 16C may be selected in advance before executing the trace operation as to whether a pause is made or whether the presser foot 45 is lowered, and then stored in the memory 73B and the like. A selection processing in this case is described in FIG. 10.

When a routine for selecting a pause or the lowering operation of the presser foot 45 at a vertex is started (S41), the CPU 71 calculates coordinates of each vertex of the outline data 96 based on embroidery data for the embroidery pattern 95 stored in the memory 73A, and stores the coordinates in the memory 73B (S42). After setting the number of the vertexes of the outline data 96 calculated at S42 as a loop counter in the memory 73B (N=4 in this case, S43), the CPU 71 sets the first vertex (S44), and indicates whether to execute the pause on the vertex on the display 17. When the execution of the pause is selected at the vertex (S45: Yes), the CPU 71 stores the selection in the memory 73B (S46). When the non-execution of the pause is selected (S45: No), the CPU does not store it in the memory 73B but shows whether to lower the presser foot 45 on the display 17. As is the case of selecting the pause, when the execution of the lowering operation of the presser foot 45 is selected (S47: Yes), the CPU 71 stores it in the memory 73B (S48); when the non-execution of the lowering operation of the presser foot 45 is selected (S47: No), the CPU 71 does not store it in the memory 73B. After that, the CPU 71 decrements the loop counter value N (S49). When the loop counter reaches 0 (S50: Yes), the CPU 71 finishes the selection processing (S52). When the loop counter is not equal to 0 (S50: No), the CPU 71 sets the next vertex (S51) and repeats the same processing, in order to set all vertexes of the outline data 96 in advance. S46 and S48 function as a setting device for a stop point and a lowering point where the presser foot is lowered.

Figure 8:
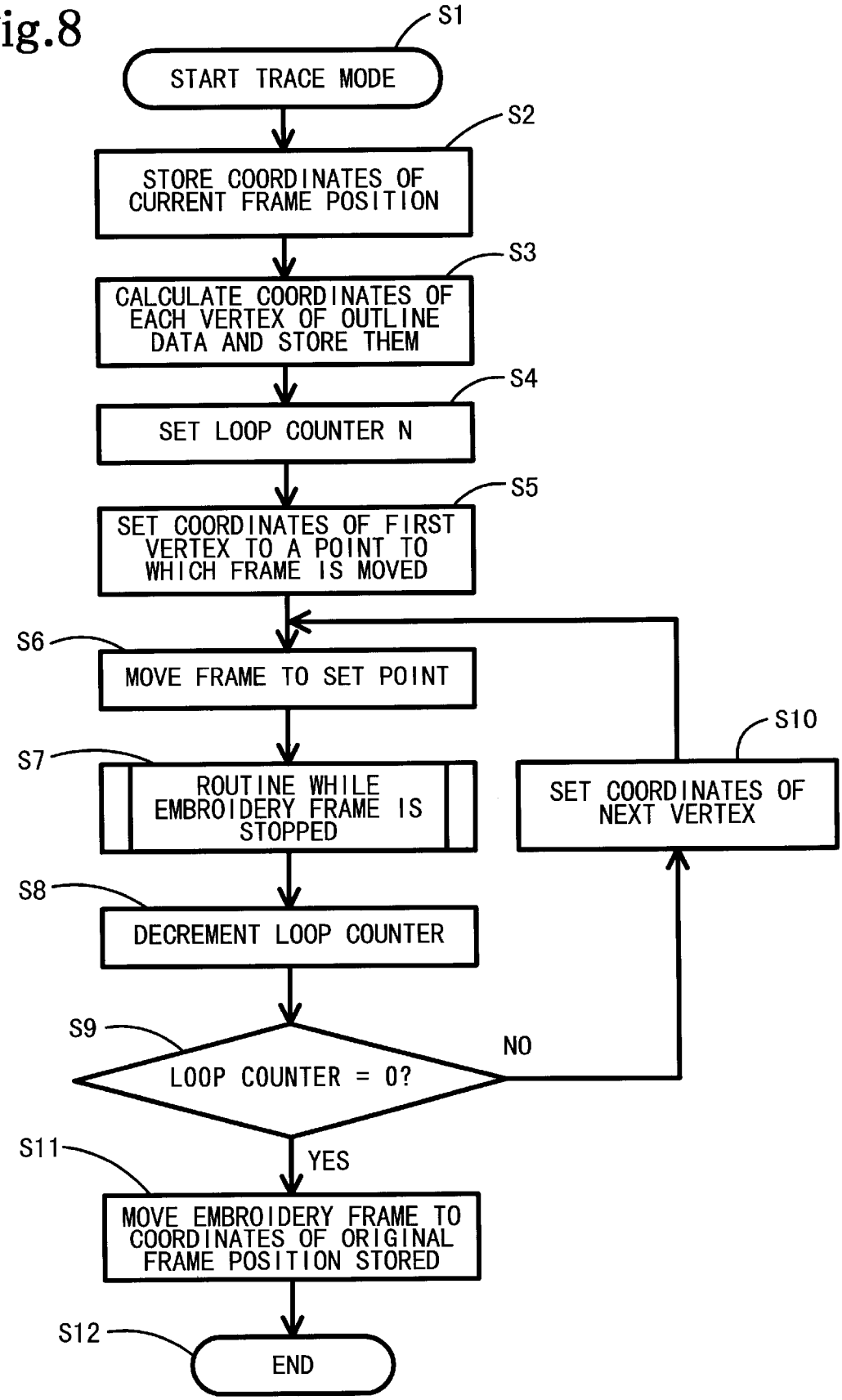
FIG. 8 is a flowchart of a main routine in a trace mode.

In this embodiment, when the trace mode of FIG. 8 is started (S1) after the selection processing is completed, the CPU 71 calls a routine while the embroidery frame is stopped in FIG. 11 from S7. The CPU 71 checks whether the vertex is set for a pause. When the vertex is not set for a pause (S62: No), neither the pause nor the lowering operation of the presser foot 45 is performed at the vertex, and the CPU 71 immediately exits the routine, returns to the main routine (S68), and executes S8 and the following steps in FIG. 8. When the vertex is set for the pause (S62: Yes) but it is not set for lowering the presser foot 45 (S63: No), the presser foot 45 is not lowered, a timer measures a predetermined time for the pause while the embroidery frame is stopped without the presser foot 45 lowering (S67), and the CPU 71 exits the routine while the embroidery frame is stopped, returns to the main routine (S68), and executes S8 and the following steps. If the vertex is set for the lowering operation of the presser foot 45 (S63: Yes), the presser foot 45 is lowered (S64), and is kept lowered until the timer has measured a predetermined time (S65), and then is returned to its original raised position (S66). The CPU 71 exits the routine while the embroidery frame is stopped, returns to the main routine (S68), and executes S8 and the following steps in FIG. 8. S64 functions as a lowering device of the invention, and S65 functions as a measuring device.

As mentioned above, in the embroidery machine according to the embodiment, the trace mode is executed by the TRACE key 18F on the operation panel 18. In the routine while the embroidery frame is stopped (S21), if the STOP key 18B on the operation panel 18 is not turned on (S22: No), a pause is assumed not to be selected on the point where the embroidery frame is moved at S6, and the embroidery frame 16*c* moves to the next vertex of the outline data 96 (S8 or later). When the STOP key 18B is turned on (S22: Yes), the embroidery frame 16C is temporarily stopped, so that the operator can visually check the positional relationship between the needle 22 and the embroidery frame 16C. This state can bc continued so long as the OK key 18A and the DOWN key 18C are not selected (S23: No, S24: No). When it is necessary to check the positional relationship in detail, the DOWN key 18C is selected (S24: Yes), and the presser foot 45 is lowered (S25), so that the operator can check the positional relationship between the needle 22 and the embroidery frame 16C via the relationship between the presser foot 45 and the embroidery frame 16C. The presser foot 45 can be kept lowered so long as the OK key 18A is not selected (S26: No).

As in the selection processing shown in FIG. 10, the vertexes of the outline data 96 close to the embroidery frame 16C are set in advance for selecting a pause or lowering operation of the presser foot and stored in the memory 73B. In the routine for selecting a pause or the lowering operation of the presser foot 45 (S41), based on the embroidery data of the pattern 95 stored in the memory 73*a* of the controller 70, the vertexes of the outline data 96 calculated in the CPU 71 are selected in order as to whether a pause is made and, then, as to whether the presser foot 45 is lowered. The selection can be stored in the memory 73B (S45, S46, S47, S48).

In this case, when the trace mode is started (S1), the CPU 71 calls the routine while the embroidery frame is stopped, in FIG. 11, from S7. Based on the predetermined settings of the vertexes of the outline data 96, a pause and the lowering operation of the presser foot 45 is made at each vertex repeatedly for a specified time set in the timer. Thus, the trace mode can be automatically executed.

The invention is not limited to the above embodiment. It will be appreciated that various kinds of improvements and modifications may be made without departing from the principle of the invention.

For example, the outline data 96 for the embroidery area including the embroidery pattern 95 is represented by a rectangle in the embodiment, but this is not limited. A rectangle is just exemplary. Any shape, such as a polygon and a curved shape, including a circle is possible so long as the shape can cover the embroidery pattern completely. The embodiment describes the checking operations as to the vertexes of the outline data, but other than the vertexes, points on a side or a curved line can be set as places to check the positional relationship between the needle 22 and the embroidery frame 16C. Additionally, times taken for the pause and the lowering operation of the presser foot 45 can be changed by the operator. Furthermore, data as to the selection of a pause and the lowering operation of the presser foot 45 can be stored in other media, such as a hard disk, a floppy disk, and a magnetic tape, as well as the memory 73B.

The OK key 18A, the STOP key 18B and the DOWN key 18C are made of an electronic switch using a piezoelectric element, but are not limited to this. A mechanical switch, such as a push switch and a snap switch, can also be used.

What is claimed is:

1. A sewing machine capable of tracing an embroidery area that includes an embroidery pattern before embroidering onto a cloth held by an embroidery frame, by moving a needle and a presser foot, which are away from the cloth, relative to the embroidery frame along an outline of the embroidery area, while stopping at one or more stop points, the sewing machine comprising:

an actuator that lowers the presser foot; and a lowering device that controls the actuator to lower the presser foot at the one or more stop points during a trace operation.

2. The sewing machine according to claim 1, further comprising a measuring device that measures time elapsing while the presser foot is lowered at the one or more stop points, wherein the needle and the presser foot are relatively moved to a next stop point when the time measured by the measuring device has reached a predetermined time.

3. The sewing machine according to claim 2, further comprising a point selecting device that selects at least one of the one or more stop points as a lowering point where the presser foot is lowered.

4. The sewing machine according to claim 3, wherein the point selecting device selects the at least one of the one or more stop points as the lowering point during the trace operation.

5. The sewing machine according to claim 1, further comprising a point selecting device that selects at least one of the one or more stop points as a lowering point where the presser foot is lowered.

6. The sewing machine according to claim 5, wherein the point selecting device selects the at least one of the one or more stop points as the lowering point during the trace operation.

7. The sewing machine according to claim 1, further comprising:

a memory;

a setting device that stores, in the memory, the one or more stop points and one or more lowering points where the presser foot is lowered; and a measuring device that measures time elapsing while the presser foot is lowered at the one or more lowering points, wherein the needle and the presser foot relatively move while stopping at the one or more stop points based on settings in the memory, the presser foot is lowered by the lowering device at the one or more lowering points based on the settings in the memory, and the needle and the presser foot relatively move to a next stop point when the time measured by the measuring device has reached a predetermined time.

8. A method of tracing an embroidery area that covers an embroidery pattern before embroidering onto a cloth held by an embroidery frame by moving a needle and a presser foot, which are away from the cloth, relative to the embroidery frame along an outline of the embroidery area, while stopping at one or more stop points, comprising the step(s) of:

lowering the presser foot by an actuator at the one or more stop points during a trace operation.

9. The method according to claim 8, further comprising the steps of:

measuring time elapsing while the presser foot is lowered at the one or more stop points; and moving the needle and the presser foot relatively to a next stop point when the time measured by the measuring device has reached a predetermined time.

10. The method according to claim 9, further comprising the step of selecting at least one of the one or more stop points as a lowering point where the presser foot is lowered.

11. The method according to claim 10, wherein the at least one of the one or more stop points is selected as the lowering point during the trace operation.

12. The method according to claim 8, further comprising the step of selecting at least one of the one or more stop points as a lowering point where the presser foot is lowered.

13. The method according to claim 12, wherein the at least one of the one or more stop points is selected as the lowering point during the trace operation.

14. The method of claim 8, further comprising the steps of:

storing, in the memory, the one or more stop points and one or more lowering points where the presser foot is lowered; and measuring time elapsing while the presser foot is lowered at the one or more stop points, wherein the needle and the presser foot are relatively moved while stopping at the one or more stop points based on settings in the memory, the presser foot is lowered at the one or more lowering points based on the settings in the memory, and the needle and the presser foot are relatively moved to a next stop point when the time measured by the measuring device has reached a predetermined time.

15. A computer-readable storage medium that stores a program for tracing an embroidery area that covers an embroidery pattern before embroidering onto a cloth held by an embroidery frame by moving a needle and a presser foot, which are away from the cloth, relative to the embroidery frame along an outline of the embroidery area, while stopping at one or more stop points, the program comprising:

a routine for lowering the presser foot by an actuator at the one or more stop points during a trace operation.

16. A method for checking the sewability of an embroidery pattern on a work cloth held by an embroidery frame, comprising the steps of:

defining a pattern trace that encloses the embroidery pattern;

designating checkpoints on the pattern trace for checking clearance between the embroidery frame and a needle and a presser foot of a machine for embroidering;

moving the needle and pressure foot relative to the embroidery frame along the pattern trace;

selectively stopping the relative movement at a checkpoint; and selectively lowering the presser foot at a checkpoint, where the presser foot need not be lowered at each checkpoint where the relative movement is stopped.

17. The method according to claim 16, wherein the selective stopping of the relative movement is directed during the relative movement along the pattern trace.

18. The method according to claim 17, further comprising the step of instructing lowering of the presser foot when the relative movement is stopped.

19. The method according to claim 16, wherein the selectively stepping step comprises the steps of designating at least one checkpoint for stopping prior to commencing the relative movement; and storing the selected at least one checkpoint in a relative movement memory.

20. The method according to claim 19, wherein the selectively lowering step comprises the steps of:

designating a checkpoint for lowering the presser from the at least one checkpoint selected for stepping; and storing the selected checkpoint in the memory.

* * * * *